US005393958A

United States Patent [19]

Gross et al.

[11] Patent Number: 5,393,958

[45] Date of Patent: Feb. 28, 1995

[54] HEATER WITH A PRETENSIONED HEATING ELEMENT

[75] Inventors: Martin Gross, Kämpfelbach; Eugen Wilde, Knittlingen, both of Germany

[73] Assignee: E.G.O. Elektro-Gerate Blanc u. Fischer, Germany

[21] Appl. No.: 116,145

[22] Filed: Sep. 2, 1993

[30] Foreign Application Priority Data

Sep. 3, 1992 [DE] Germany ..... 4229373

[51] Int. Cl.[6] ..... H05B 3/68

[52] U.S. Cl. ..... 219/464; 219/467; 219/468

[58] Field of Search ..... 219/443–468; 338/284, 285, 290, 278, 280, 281

[56] References Cited

U.S. PATENT DOCUMENTS

| | | | |
|---|---|---|---|
| 3,501,624 | 3/1970 | Pansing | 219/464 |
| 3,991,298 | 11/1976 | Maake | 219/464 |
| 4,161,648 | 7/1979 | Goessler | 219/464 |
| 4,292,504 | 9/1981 | Gebarowski et al. | 219/459 |
| 4,504,731 | 3/1985 | Fischer | 219/457 |

FOREIGN PATENT DOCUMENTS

| | | | |
|---|---|---|---|
| 1962568 | 8/1970 | Germany . | |
| 3129239 | 2/1983 | Germany . | |
| 2238450 | 5/1991 | United Kingdom | 219/464 |

*Primary Examiner*—Bruce A. Reynolds
*Assistant Examiner*—John A. Jeffery
*Attorney, Agent, or Firm*—Quarles & Brady

[57] ABSTRACT

Heating resistors and/or series resistors (10) are curved in flat corrugation manner from flat band and are so pressed into the bottom (7) of an insulation (3), that they are only prevented by friction from rising from the bottom (7). The resistor (10) has non-offset, uninterrupted, through-edge faces (14, 15). Thus, in the case of a very simple construction, a surface-specific, high power density can be obtained.

29 Claims, 4 Drawing Sheets

1
2
3
4
5
6
7
8
9
10
14
15
16
20
21
22
25
27

HEATER WITH A PRETENSIONED HEATING ELEMENT

BACKGROUND OF THE INVENTION

The invention relates to a heater, particularly for cookers, such as can be used e.g. as a radiant heater or other heater for heating a hot plate, a baking oven muffle or the like. Such heaters generally form a closed unit, which as such are fixed to the corresponding appliance, e.g. a hob, a muffle wall or the like. One heating side of the heater then forms the corresponding large-surface outlet for the heat output of the heater. Resistors, such as heating resistors, series resistors, etc., can be provided in a plane, which is approximately parallel or set back in spaced manner from the outlet plane.

With the particular resistor is appropriately associated insulation, which simultaneously can form the sole support for the mechanical holding of one or all the resistors and which appropriately has a through surface extension, which is roughly the same as the heat outlet, and for this purpose is particularly suitable a planar, plate-like or a few millimeters thick insulation construction. The insulation is mainly electrically insulating but can also be thermally insulating, but must not be opaque visible thermal radiation, e.g. infrared radiation at least in the vicinity of the engagement of the particular resistor. At least in these areas the insulation can also be constructed in such a way that from the engaging portion of the resistor not only in the first phase of putting into operation, but also during permanent operation, roughly the same amount of heat is led off as from the non-engaging portion or at least the largest parts thereof.

It is relatively difficult to prevent resistors from lifting on an insulation which is moulded or pressed from a pasty-shaped, poured charge with minimal fibres, grains, binders, etc. and then dried or hardened. However, the securing against lateral movements by engagement in depressions or between projections of the insulation is less difficult. To prevent lifting it is possible to use fastening members, which can be in the form of clips, adhesion points or similar separate components or in the form of bent projections, and formed in one piece with the resistor, said members being connected to the resistor and also engaging in the insulation.

Particularly in the case of flat resistors such fastening members form resistance-inactive components to the extent that they do not contribute to the electrical resistance value and namely, much as in the case of blank branches, there is no flow through them by the current or the flow is significantly reduced compared with the portions having a maximum flow density. In the case of certain constructions these fastening members increase the degree of complication and possibly also the weight of the heater and are essentially only heated by heat conduction or radiation from the resistance-active areas of the heating resistor, but not as a result of their own resistance. Wound wire resistance coils can be embedded in tightly surrounded manner in the insulation with resistance-active fastening portions. This also applies for flat resistors, which are fixed to the insulation, e.g., as non-inherently stable, evaporated-on coating embedded at least partially or completely between the insulating layers. Compared with such resistors, flat resistors have considerable advantages, their resistance-active cross-sections at least partly not being parallel to the heating side or plane, but being inclined or at right angles thereto, because also in the case of a higher resistance capacity they take up less space transversely to their longitudinal direction and approximately parallel to the heating plane and can consequently be provided in higher power density and better insulated against creepage currents. However, for the aforementioned reasons, their securing against lifting is more difficult.

OBJECTS OF THE INVENTION

An object of the invention is to provide a heater, which avoids the disadvantages of known constructions or those of the type described hereinbefore. Another object is to positionally secure a resistor having flat cross-sections in the vicinity or outside the latter in simple manner to the insulation, particularly against lifting off, even if parts of the particular flat cross-section are oriented substantially at right angles to the heating plane. Still another object is to avoid thermal overloading of the insulation. A further object is to incorporate into the operationally effective electrical resistance a large number of conducting or metal members, which are electrically conductively connected to the resistor.

SUMMARY OF THE INVENTION

According to the invention means are provided through which the resistor is prevented from lifting by direct engagement connection of a resistance-active area to the insulation. In the vicinity of the fastening portion and/or connected to or longitudinally spaced therefrom, the resistor has at least one elongated longitudinal portion with a full flat cross-section, which is at least partly at right angles to the heating plane.

If the resistor or the fastening portion has on its edge face facing the insulation core or on the other edge face no offset projecting cross-sections which, compared with the resistance-active cross-sections, are countersunk in the fastening member engaging in the insulation in the manner of a blank branch, the fastening portion or the resistor can exclusively have resistance-active cross-sections over its entire one-piece longitudinal extension. As a result the construction height of the insulation, the resistor and the complete heater can be reduced if said longitudinal edge face essentially of all the longitudinal portions of the resistor are substantially in a single plane. If there are no spaced, juxtaposed resistor longitudinal portions, or portions which are interconnected by means of a curvature arc and which engage to varying depths in the insulation, or whose longitudinal directions are at an angle to one another. The central longitudinal axis of all the fastening portions or all the longitudinal portions can be in a single plane, which can define the heating plane.

Advantageously for securing against lateral movements, the heating resistor is supported in a direct flat manner on the insulation parallel to the heating plane, its two lateral faces under substantially all operating conditions, at the same or different height engaging closely on approximately parallel supporting faces of the insulation. Instead of only a support in the vicinity of a sharp edge of an edge face and not also spaced from said edge face, this leads to a very good lateral support action. The resistor can also be secured against movements towards the insulation core, if over at least half its length or its entire length it is supported with the associated edge face on the insulation in at least one operating state. If the particular fastening portion is resilient, e.g., is pretensioned in that roughly parallel to the heating plane it engages in curved manner in the insulation, as a result of the widening and/or narrowing acting spring tension, there is an additional locking action with respect to the insulation.

In a preferred construction the fastening portion or the entire resistor is formed by a flat wire or band, whose longitudinal edge in the stretched, i.e., longest state, is approximately linear throughout and/or whose lateral faces can also be free from any projections or breaks. The material thickness of the flat cross-section can be well below 0.5 mm and, as a function of the requirements can be any integral multiple of 0.1 mm or 0.01 mm, e.g., 0.07 mm. The material width or height of the flat cross-section is appropriately several millimeters, particularly less than 10 or 5 mm and as a function of the requirements in these areas can be any integral multiple of 0.5 mm and/or 1 mm, e.g. 3 mm. The greatest engagement depth of this flat cross-section in the insulation is appropriately at least one quarter the material width or the width between the edge faces and at the most a fraction more than said width. The penetration depth, as a function of the requirements, can amount to any integral multiple of 0.5 mm and/or 1mm. The fastening portion can be such that the flow of current therethrough can be less than the remaining portion of the resistor.

Independently of the described features a very advantageous construction of the heater is obtained if the insulation is at least partly formed within its cross-sections as a light guide and/or on at least one surface as a light exit window and is therefore connected to at least one illuminating source. In a simple manner the illuminating source can be the resistor emitting infrared radiation in operation, which is, e.g., distributed in a large-surface or approximately uniform manner over the insulation and whose radiation is then propagated in a large-surface manner within the insulation and also exits on the heating side. As a result the entire insulation can be used in whole or in part surface manner as an illuminating plate, which can be seen as an indication of the operating state through the covering, translucent and/or transparent cover plate made from a glass ceramic material or the like. By partial darkening and/or cross-sectional mixing with an opacifier, the light guide and/or the light exit function can be modified in such a way that specific, desired patterns are obtained. In the light-guiding areas or the areas provided for light exit, no opacifier is provided and the latter is instead replaced by a translucent admixture, e.g., quartz powder, or a different grain size. The remaining constituents of the insulation are appropriately light coloured to white and/or translucent in these areas.

In order that the insulation does not have a tendency to sinter or to brittle hardening, even under high operating temperatures and instead remains compressive or tensile elastic, corresponding components are added thereto. As a result the insulation remains reversibly deformable and/or rebound elastic without tearing and can adapt to its own thermal expansions or those of the resistor or the fastening portion.

BRIEF DESCRIPTION OF THE DRAWINGS

These and further features can be gathered from the claims, description and drawings and the individual features, either singly or in the form of subcombinations, can be realized in an embodiment of the invention and in other fields and can represent advantageous, independently protectable constructions for which protection is hereby claimed. Embodiments of the invention are described hereinafter relative to the drawings, wherein:

DETAILED DESCRIPTION OF A PREFERRED EXAMPLE EMBODIMENT

Figure 1:
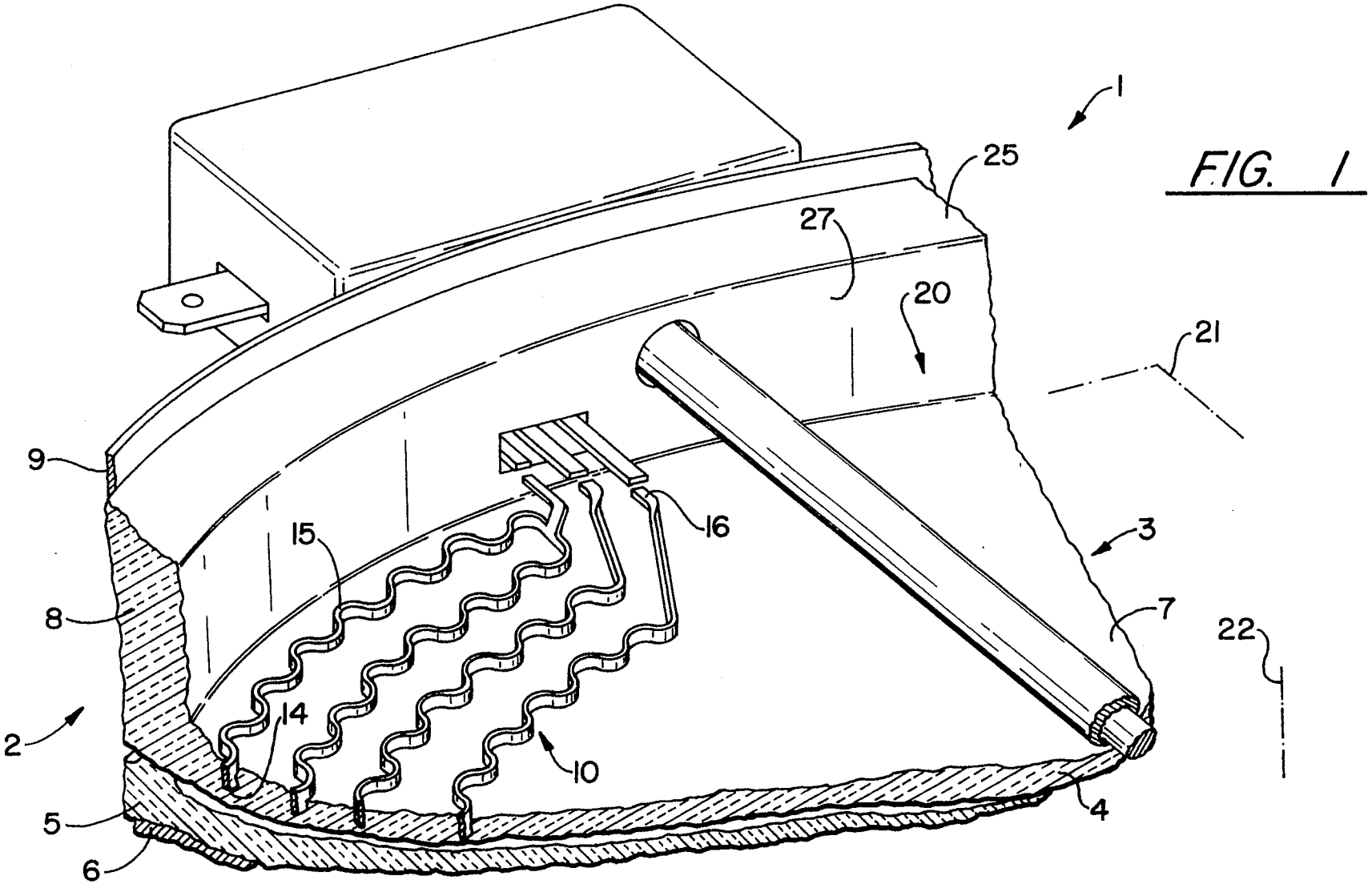
FIG. 1 is a detailed view of a heater according to the invention in a perspective.
Figure 2:
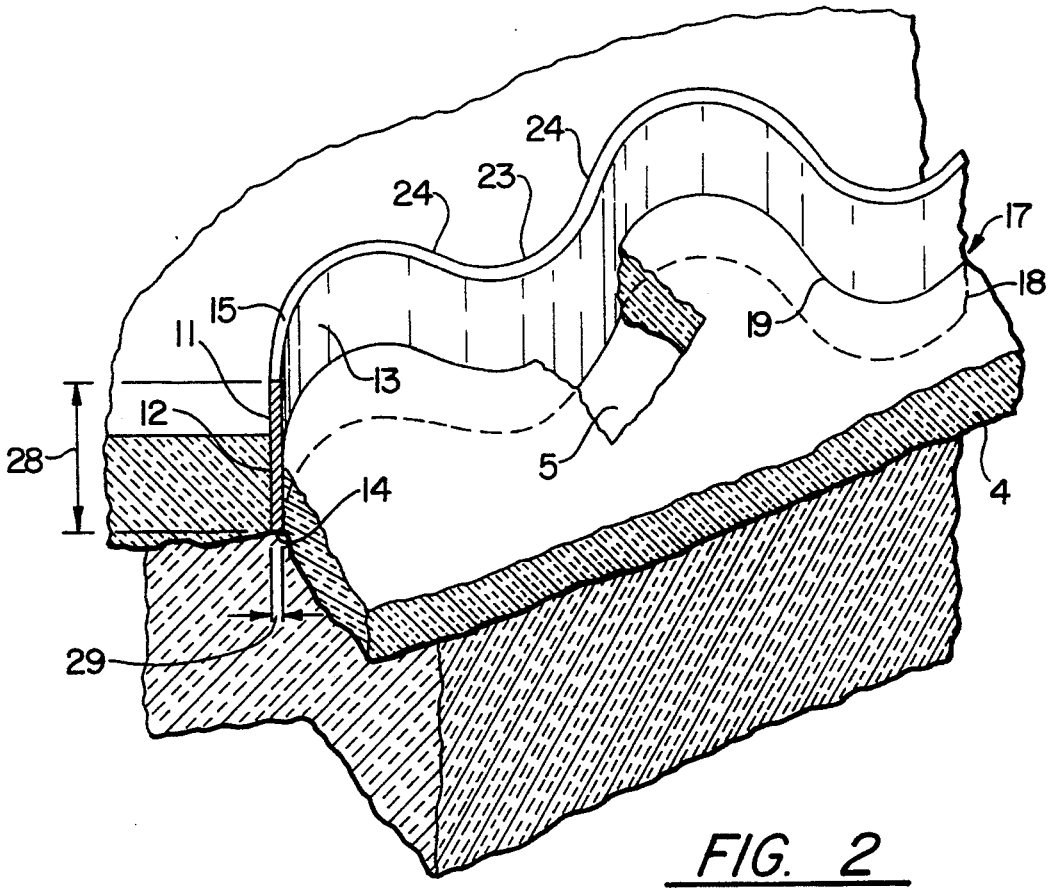
FIG. 2 is a detailed view of another embodiment shown on a larger scale.

The heater 1 has a substantially dimensionally stable, multipart, cup-shaped base 2, whose cup opening substantially completely forms the thermal outlet. The largest material volume of the base 2 forms a substantially two or three-part insulation 3 constituted by a support body 4 and an insulator 5. The support body 4 has in particular electrically insulating characteristics and forms the substantially planar and/or smooth-surfaced cup bottom which is exposed to the thermal outlet. The support body 4 is supported in flat manner on an approximately plate-insulator 5, which has better thermal insulation characteristics than the support body 4 and can only engage thereon in the marginal area and/or at least one ring area, so that a gap is left between a large surface of the two bodies 4 and 5. The mechanical strengths, such as the compressive, bending, tensile and/or shear strength of the insulator 5 can be lower than those of the support body 4, and both are arranged in a holder 6 made from a material having a higher strength, e.g., in a sheet metal tray, which secures the insulation 3 axially and/or radially in a substantially clearance-free manner.

Over the bottom 7 of the insulation 3 projects in an axial manner a ring-like, through, insulating material edge 8, which forms the cup opening and which according to FIG. 1 is constructed in one piece with the support body 4 and is made from an insulating material, which is similar to the support body 4 and/or the insulator 5. This edge 8, whose radial thickness is greater than that of the support body 4, is closely surrounded by a circumferential edge 9 of the holder 6, which here projects axially over the free face of the edge 8, but in the installed state does not engage directly on the cover plate, e.g., through an insulating ring mounted on the edge 8 and which projects over the edge 9.

To the bottom 7 are fixed several elongated, strand-like resistors 10, so that they are secured in substantially clearance-free manner against movement parallel to the bottom 7 or to its longitudinal extension, or with respect to lifting movement at rights angles to the bottom 7. The resistors 10, which are shown here as heating resistors and are at least partly provided in a free manner within the cup space, can in interengaging single or multiple spiral turns or spirals be positioned roughly parallel to the edge 8. The resistors 10 are preferably substantially uniformly distributed over a field, which over the entire circumference is roughly connected to the inner circumference of the edge 8 and extends into the center of the bottom 7.

Over its entire length each resistor has identical, approximately rectangular flat cross-sections in that it is made from a flat band, which is further processed in non-cutting manner or accompanied by the removal of material portions, in order to produce the heating resistor.

The flat band is only bent. It has two cross-sectionally parallel lateral faces 12 and 13 and two very narrow edge faces 14 and 15 connecting them, its thickness 29 being, e.g., approximately 0.07 mm and its greatest cross-sectional width 28 can, e.g., be approximately 3 mm. The particular band end of the resistor 10 can be constructed directly and without additional intermediate members as an electrical connection end 16 or can be brought into position by either bending or twisting with respect to the remaining resistor 10 in which it is contact-free with respect to the insulation 3 and is particularly suitable for electrical connection.

A one-piece, through flat band can also form two adjacent, separately switchable resistors, if the latter at their ends pass via a transverse portion in one piece manner into one another and/or the transverse portion connecting said individual resistors is constructed in one piece with a corresponding connecting end.

The resistor 10 forms over most or its entire length an uninterrupted, fastening portion 17 in such a way that it is in engagement with the support body 4 uninterruptedly over the said length, so that it is secured against movements in said directions with respect thereto. For this purpose an engagement portion 18 connected in strip-like manner to an edge face 14 is uninterruptedly embedded in a corresponding groove-like depression 19 of the support body 4. Between the two edge faces 14 and 15, the flat cross-section 11 forms uninterrupted, through, resistance active cross-sections, so that also the engagement portion 18 is resistance active to the same extent as the portions of the flat cross-section 11 projecting freely over the bottom 7.

The engagement depth of the engagement portion 18 can, e.g., be approximately 2 mm or 2/3 of the total width of the flat band. In the vicinity of the common longitudinal portion, the two lateral faces 12 and 13 can engage at different heights on the insulating material of the support body 4 or with the same height, as a function of the emission conditions or coupling effects to be obtained. As a function of whether the particular spiral portion is elastically pretensioned by widening or narrowing in an area, it is under spring tension with the inner or outer lateral face 13 or 12.

The resistors 10 are located on the heating side 20 of the bottom 7 or the base 2 facing the cup opening and determine, e.g., with their edge faces 15 located closer to the thermal outlet, a heating plane 21 roughly parallel to the bottom 7. The heater 1 has a central axis 22 at right angles to said heating plane 21 and about which the resistors 10 are curved. In addition to its elastic large curvature, each resistor 10 has a longitudinally alternating, e.g. sine wave-like curved configuration in that in a view on the heating plane 21 it is alternately provided with oppositely directed, but substantially identical curvatures 23 and adjacent curvatures with their approximately linear or planar legs 24 pass in one piece into one another.

Correspondingly the engagement portion 18 and the groove-like depression 19 are curved in a permanent or inherently rigid manner, the legs 24 diverging from the particular curvature 23, appropriately under an angle of more than 30°, 60° or 90°. Therefore, thermal longitudinal expansions of the resistor become relatively unproblematical, namely are mainly transferred in the longitudinal direction of the depression 19 to the support body 4. By stretching and/or compression of the corrugation or the resistor 10, the fastening portion can be pretensioned longitudinally in individual part or all longitudinal portions, so that it resiliently engages with tension on corresponding transverse flanks of one or both lateral faces of the depression 19. The two legs 24 of in each case one wave crest can form a correspondingly narrowed or widened, pretensioned clip, which engages with pretension on the associated lateral face of the depression 19. At least in the vicinity of said lateral faces said support body 4 is rebound compression elastically resilient under said tensional forces, so that there is a very secure holding claw engagement of the resistor 10. The compressive strength of the material of the resistor 10 is much higher than this.

Figure 3:
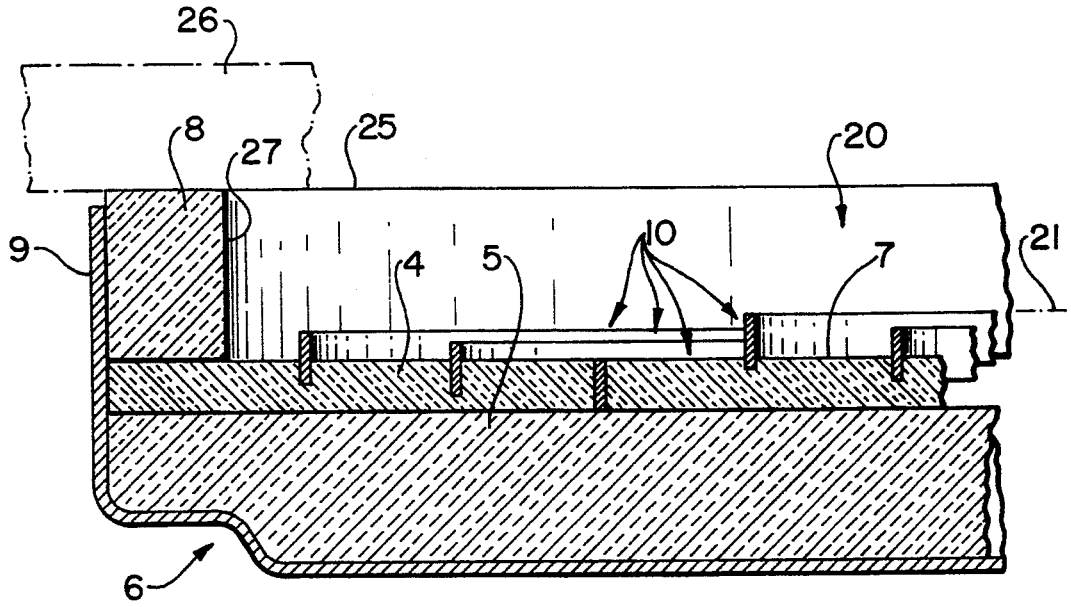
FIG. 3 is a view of another embodiment of a heater shown in section.
Figure 4:
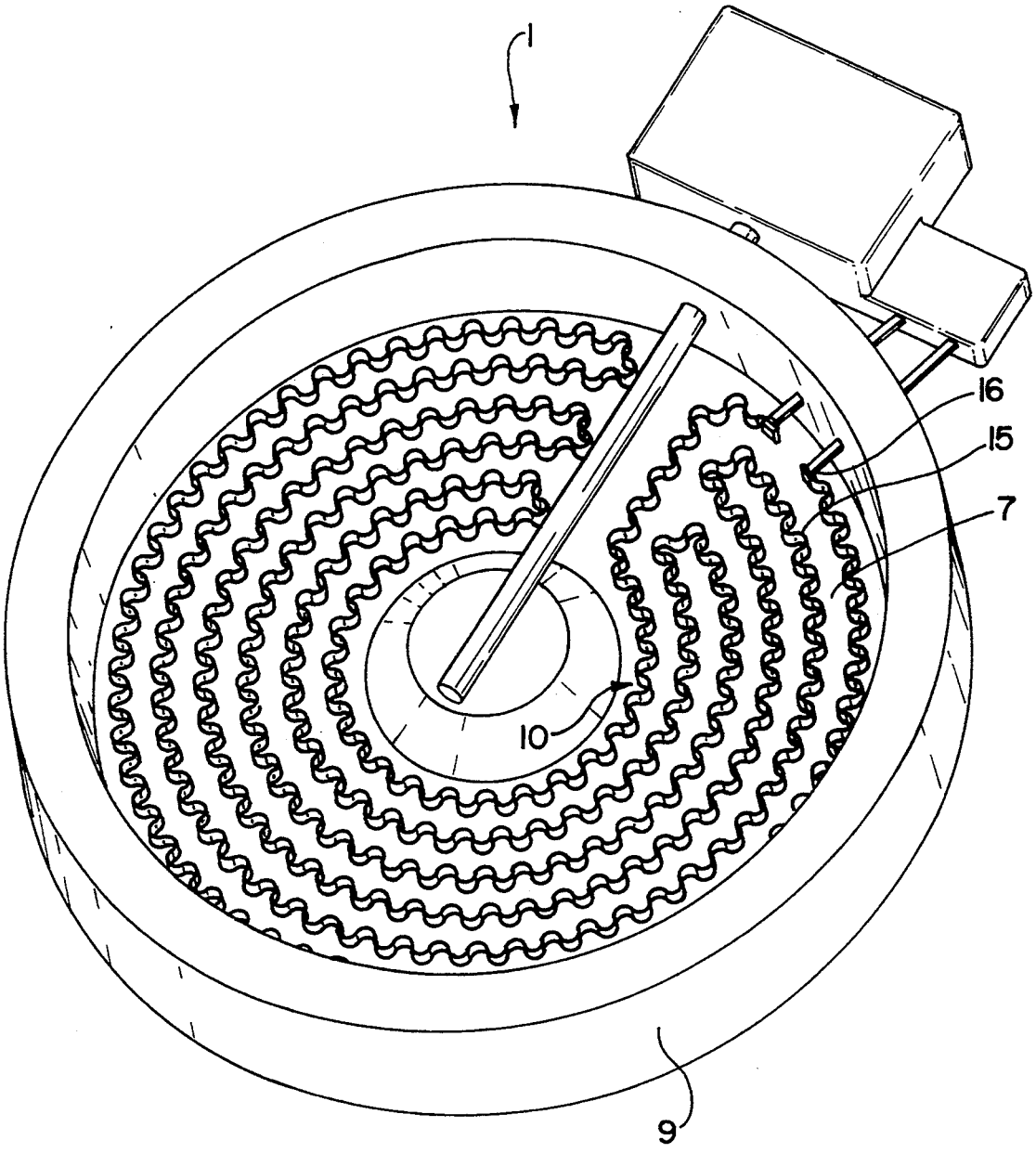
FIG. 4 is a perspective view of the entire heater of the invention.
Figure 5:
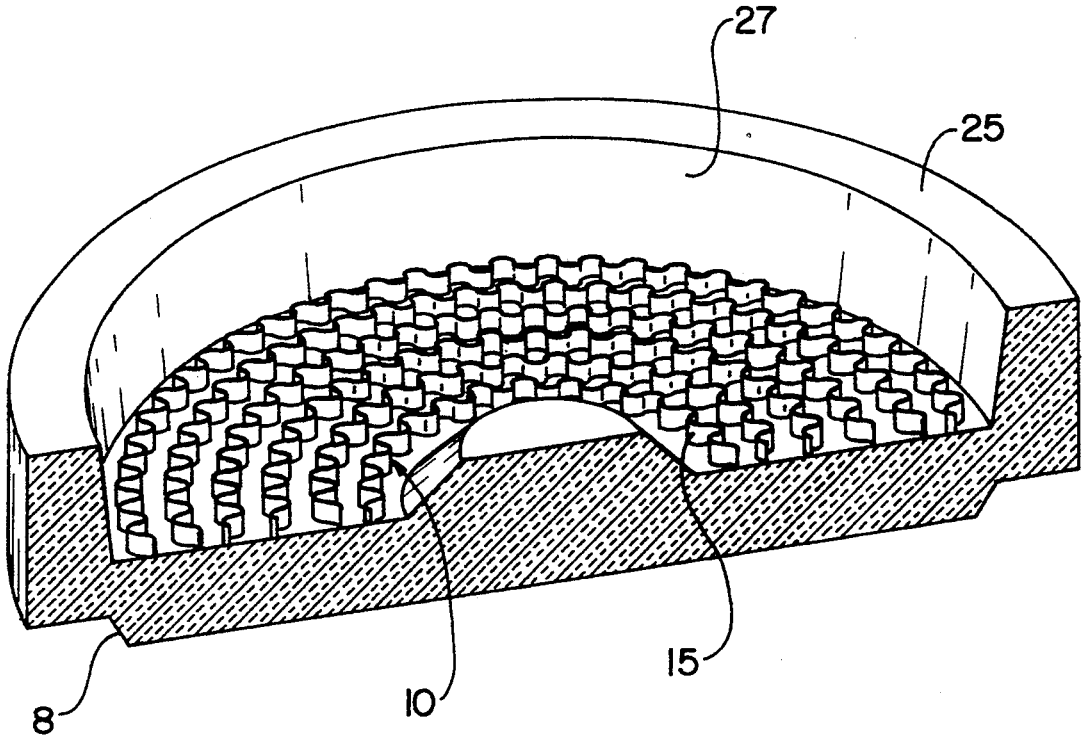
FIG. 5 is a perspective, partial cross-sectional view of selected components of the heater according to the invention.

The inner circumference 27 of the edge 8, which according to FIG. 3 can also form a component separate from the support body 4, limits the thermal outlet or output of the heater 1 at the outer circumference. According to FIG. 3 the free face 25 of the edge 8 projects by a small amount over the face of the edge 9, so that a radiotransparent cover plate 26 made from a glass ceramic material or the like can engage with planar back or under-side and under pressure pretensioned on said face 25. The projection amount, which can e.g. be roughly the same as the sheet metal thickness of the holder 6, is so large that between the back of the cover plate 26 and the edge 9 there is only a small gap. If under the pressure or through the ageing of the edge 8, the face 25 is displaced towards the heating plane 21, as a result the edge 9 cannot come into direct contact with the cover plate 26 and instead the gap is at the most reduced to a minimum of e.g. 1 mm or the like.

The heating plane 21 is set back with respect to the face 25 or the cover plate 26. The heating resistor or separate heating resistors can project freely to a different extent over the bottom 7 towards the heating side 20, can engage to different depths in the support body 4, and can have different band width and/or band thickness, so that areas of the heating field can be created which have different power densities or different response sensitivities with respect to the heating action and glowing.

The corrugated resistor can, without prior production of the depression 19, be pressed in the dry prefabricated or still moist shapable support body 4. On pressing into the support body 4 the insulating material gives way in a compressing manner and then springs or flows back against the engagement portion 18, so that the resistor 10 is then very well positively secured against lifting from the bottom 7. The resistor 10 could admittedly be pressed in until its edge face 14 or the fastening projections strike against the insulator 5, but appropriately the edge face 14 exclusively engages in the support body 4.

All the described constructions, components, units or spaces can be provided either singly or in combination e.g. in order to switch several heating zones and/or circuits in different power stages.

We claim:

1. A heater defining a heating field (20) and a heating plane (21) and comprising:

a plurality of assembling members (2, 10) defining an assembled state for heating operation and a non-assembled state, said assembling members (2, 10)

including a base (2) including at least one counter face (19) in the vicinity of said heating field (20), at least one structural member (10), and a supporting structure (17) including at least one individual support leg (18) having remote side faces (12, 13), lateral edge faces and a vertex end (14), said edge faces of said individual support leg (18) defining lateral edge planes and median leg planes being defined between said side faces (12, 13), in the assembled state, said vertex end (14) being provided at an end of an overall linear longitudinal leg extension of said support leg (18) defining a longitudinal leg direction, at least one of said structural member (10), said supporting structure (17) and said support leg (18) defining first length sections repeatedly followed by second length sections, at least one of said structural member (10), said supporting structure (17), said support leg (18), said first length section and said second length section defining a length extension transverse to said longitudinal leg direction, cross-sections being defined including at least one longitudinal cross-section parallel to said longitudinal leg direction and at least one transverse cross-section transverse to said longitudinal leg direction, in at least one of said cross-sections, at least one of said support leg (18) and said structural member (10) defining a material thickness (29) between said side faces (12, 13), at least one of said side faces (12, 13) including a support flank (12, 13) for supporting said support leg (18) against said counterface (19) in a supporting area provided at a distance from said vertex end (14) of at least said material thickness, and wherein in the non-assembled state of said support leg a premanufactured profile provides at least one of said support flank (12, 13), said profile extending along said longitudinal leg extension and substantially between said lateral edge planes of said individual support leg (18), said profile including profile sections, in at least one of said transverse cross-section of said individual support leg (18), at least one of said profile sections extending transverse to at least one of said median leg planes, in one of said transverse cross-sections of said individual support leg (18), at least one of said support flank (12, 13) being uninterrupted over said support leg (18), said individual support leg being curved substantially parallel to said heating plane (21), thereby within said support leg (18) said profile being at least partly an inherently stiff precurved profile having at least one profile arc (23) and at least one profile leg (24) connecting to said at least one profile arc (23) in one part, said at least one profile leg (24) supportingly engaging said at least one counterface (19).

2. The heater according to claim 1, wherein said counter face includes an electrical insulator (3), said structural member providing at least one electrical resistor (10) positionally secured with respect to said insulator (3) with said supporting structure (17), at least one of said structural member (10) and said supporting structure (17) including oblong and flattened cross-sections (11) including electrical resistance-active cross-sections through which current directly flows in operation.

3. The heater according to claim 1, wherein flattened cross-sections of at least one of said structural member (10) and said supporting structure (17) extend transverse to said heating field.

4. The heater according to claim 1, wherein said supporting structure (11) includes at least one electrically resistance-active support cross-section directly engaging said at least one counter face (19) so as to be secured against lifting off at least by friction, means being provided for reducing flow of current through said support cross-section with respect to flow of current through a remaining cross-section of said structural member (10).

5. The heater according to claim 1, wherein said structural member (10) has a resistance-active longitudinal edge face (14) extending substantially over an entire length extension of an uncoiled length section of said structural member (10).

6. The heater according to claim 5, wherein said longitudinal edge face is located substantially in a single plane.

7. The heater according to claim 1, wherein said structural member (10) and said support leg (18) commonly provide flattened cross-sections provided in a standing orientation with respect to said heating field defining a heating plane (21), said flattened cross-section being substantially planar and defining a height extension substantially parallel to said standing orientation and said longitudinal direction.

8. The heater according to claim 1, wherein between remote edge faces (14, 15) said supporting structure (17) has substantially full material flattened cross-sections (11).

9. The heater according to claim 8, wherein said full material flattened cross-sections (11) are provided substantially over at least one of said overall length extension of said individual support leg (18) and an overall height extension of at least one of said structural member (10) and said supporting structure (17).

10. The heater according to claim 1, wherein at least one of said supporting structure (17) and said structural member (10) provides cross-sections (11) substantially inherently stiffer against resilient bending deformation transverse to said heating field (21) than parallel to said heating field.

11. The heater according to claim 1, wherein at least one of said profile is at least partly an inherently stiff prebent profile.

12. The heater according to claim 1, wherein on remote outermost sides of an overall cross-section said supporting structure (17) provides two substantially parallel edge faces (14, 15), one of said edge faces (14) providing said vertex end and extending substantially free of configured step sections continuously substantially entirely over said length extension of at least one of said supporting structure (17) and said support leg (18), and substantially free from resistance-inactive cross-sections.

13. The heater according to claim 1, wherein whole number multiples of said material thickness are defined, said distance being defined by one of said whole number multiples of said material thickness, said whole numbers including each number between 20 and 80.

14. The heater according to claim 1, wherein said support flank (12, 13) has an overall areal extension and continuously engages said counterface (19) over substantially entirely said areal extension closely in full-surface manner.

15. The heater according to claim 1, wherein said profile is provided in substantially stiff rigid connection with at least one of said supporting structure (17), said support leg (18) and said structural member (10).

16. The heater according to claim 1, wherein said profile is provided by a prebent profile of at least one of said supporting structure (17), said support leg (18) and said structural member (10), at least one of said structural member (10), said supporting structure (17), said support leg (18), said first length section, said second length section and said at least one profile being finished from a basic raw material defining a basic cross-section, a basic material thickness and a basic length extension substantially different from said length extension providing an operational length extension, said operational material thickness being substantially equal to said basic material thickness and said operational length extension being less than said basic length extension, said supporting structure (17) being curved in first and second superimposed curvatures, said first curvature being an undulated curvature and said second curvature being larger and providing a distributing curvature distributing said supporting structure (17) over said heating field (20), said undulated curvature providing a plurality of juxtaposed oppositely curved profile arcs (23) and said profile leg (24) interconnecting said profile arcs (23) in one part, said converter face (19) being provided by a depression having curved parallel opposing depression flanks engaging said support flanks (12, 13) said depression being curved parallel to said undulated curvature, thereby said profile leg (24) of said individual profile arc (23) providing a clip defining a clip width extension, and said profile leg (24) of said clip engaging said depression flanks.

17. The heater according to claim 1, wherein in one of said cross-sections at least said transverse side faces (12, 13) are substantially at least one of uninterrupted, linear and free of configured step sections over an entire extension of at least one of said support leg (18) and said structural member (10), and said extension being parallel to said transverse cross-section.

18. The heater according to claim 1, wherein in a view transverse to said heating field at least one of said profile includes a plurality of substantially equal profile units, said profile providing at least a section of a substantially sine-wave configuration providing diverging profile legs (24).

19. The heater according to claim 1, wherein at least one of said supporting structure (17) and said structural member (10) is provided substantially entirely by a one-piece strap web, stretchable into a linear and planar shape.

20. The heater according to claim 1, wherein said material thickness (29) is no greater than between 0.1 mm and 1/20 to 1/50 part of said longitudinal extension.

21. The heater according to claim 1, wherein at least one of said structural member (10) and said supporting structure (17) substantially uniformly engages said counter face (19) over a length extension equal to between one tenth of its linearly stretched overall length extension and said overall length extension, said longitudinal extension of said support leg (18) being a whole number multiple smaller than said overall length extension.

22. The heater according to claim 1, wherein at least one of said supporting structure (17) is fastened to said base (2) against lifting off motions substantially exclusively by frictional engagement of said at least one support flank (12, 13).

23. The heater according to claim 1, wherein in said at least one longitudinal cross-section said supporting structure (17) is free from bends and openings.

24. The heater according to claim 1, wherein said heater includes a radiant heater (1), said structural member having at least one radiant heating resistor (10) for providing at least one of said heating resistor and an encapsulated light radiator.

25. The heater according to claim 1, wherein said counter face (19) includes an insulator (3) at least partly permeable for visible thermal radiation in said supporting area, said insulator (3) being substantially free from opacifiers in the vicinity of said supporting structure (17) and containing at least one of a radiotransparent granular material and quartz resistant to substantially all occuring operating temperatures of said supporting structure (17).

26. The heater according to claim 1, wherein said counter face (19) includes an insulator (3) resilient in a substantially temperature-neutral manner with respect to deformations caused by thermal expansions of said structural member (10), said insulator (3) being elastic in a back springing manner and unsinterable under operational conditions, said insulator (3) including a granular component.

27. The heater according to claim 1, wherein said supporting structure (17) includes at least one closely adapted reception depression substantially entirely bounded by said counter face (19) in one-piece on at least one of a depression bottom surface and lateral depression surfaces.

28. The heater according to claim 1, wherein said counter face (19) extends substantially continuously over substantially entirely said length extension of said structural member (10), thereby providing a groove, at least one of said structural member (10), said supporting structure (17) and said support leg being oblong in a direction substantially parallel to said heating field.

29. The heater according to claim 1, wherein at least one of said supporting structure (17) and said support leg (18) is substantially uniformly distributed over at least one of said heating field (20) and said structural member (10), said counter face (19) positively securing at least one of said structural member (10), said supporting structure (17) and said support leg (18) over most of said length extension substantially free of motion play against motions in substantially all directions parallel to said heating field (20) and against inverse transverse tilting motions, said directions including inverse longitudinal directions parallel to said length extension and inverse transverse directions transverse to said length extension.

* * * * *